US012460491B2

(12) United States Patent
Stone et al.

(10) Patent No.: US 12,460,491 B2
(45) Date of Patent: Nov. 4, 2025

(54) TRIPPING AND FILTRATION OBJECT, SYSTEM, AND METHOD

(71) Applicant: Baker Hughes Oilfield Operations LLC, Houston, TX (US)

(72) Inventors: Matthew Stone, Humble, TX (US); Colin Patrick Andrew, Cypress, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/431,319

(22) Filed: Feb. 2, 2024

(65) Prior Publication Data

US 2025/0250872 A1 Aug. 7, 2025

(51) Int. Cl.
*E21B 23/03* (2006.01)
*E21B 23/00* (2006.01)
*E21B 23/04* (2006.01)

(52) U.S. Cl.
CPC ..... *E21B 23/03* (2013.01); *E21B 23/00* (2013.01); *E21B 23/0413* (2020.05)

(58) Field of Classification Search
CPC ..... E21B 23/00; E21B 23/03; E21B 23/0413; E21B 34/142; E21B 2200/04; E21B 33/128; E21B 33/12; E21B 43/26; E21B 43/02
See application file for complete search history.

(56) References Cited

U.S. PATENT DOCUMENTS

| | | | | |
|---|---|---|---|---|
| 4,407,368 | A * | 10/1983 | Erbstoesser | C09K 8/516 428/407 |
| 6,702,020 | B2 * | 3/2004 | Zachman | E21B 43/045 166/278 |
| 9,004,091 | B2 | 4/2015 | Joseph et al. | |
| 9,970,279 | B2 * | 5/2018 | Naedler | E21B 34/14 |
| 2009/0025923 | A1 * | 1/2009 | Patel | E21B 43/045 166/278 |
| 2019/0368295 | A1 * | 12/2019 | Machocki | E21B 17/06 |

* cited by examiner

*Primary Examiner* — Yong-Suk (Philip) Ro
(74) *Attorney, Agent, or Firm* — Baker Hughes Patent Organization

(57) ABSTRACT

A tripping and filtration object to manage a borehole operation, including a volume of material that is landable upon a seat in a borehole to create a pressure drop such that a function of the borehole subsystem is obtainable. In a second condition, the volume is passable through the seat. In a third condition the volume becomes a filtration media. A method for managing a borehole operation, including conveying an object to a landing seat in a borehole system, functioning the landing seat through application of pressure against the object on the landing seat, passing at least a portion of the object through the landing seat, and changing the at least a portion of the object into a filtration media after passing through the landing seat. A borehole system, including a borehole in a subsurface formation, a string in the borehole, and an object disposed within the string.

20 Claims, 13 Drawing Sheets

TRIPPING AND FILTRATION OBJECT, SYSTEM, AND METHOD

BACKGROUND

In the resource recovery and fluid sequestration industries efficiency in operation is often equated with substantial economic value. Reducing redundant operations and combining functions when possible is often advantageous. The art always is receptive to such value.

SUMMARY

An embodiment of a tripping and filtration object to manage a borehole operation, including a volume of material that in a first condition is landable upon a landing seat in a borehole system, the volume being of dimension and/or geometry to create a pressure drop across the landing seat such that a function of the borehole subsystem is obtainable by the application of pressure against the volume of material when seated on the landing seat, a second condition of the volume wherein at least a portion of the volume is passable through the landing seat, and a third condition of at least the portion of the volume wherein the at least a portion of the volume becomes a filtration media.

An embodiment of a borehole subsystem, including a first tool including a landing seat therein configured to mate with the object to create a pressure differential across the landing seat during application of pressure thereto, and a second tool, downstream of the first tool, the second tool configured to locate the object when at least the portion of the object is in a filtration media condition.

An embodiment of a method for managing a borehole operation, including conveying an object to a landing seat in a borehole system, functioning the landing seat through application of pressure against the object on the landing seat, passing at least a portion of the object through the landing seat, and changing the at least a portion of the object into a filtration media after passing through the landing seat.

An embodiment of a borehole system, including a borehole in a subsurface formation, a string in the borehole, and an object disposed within the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
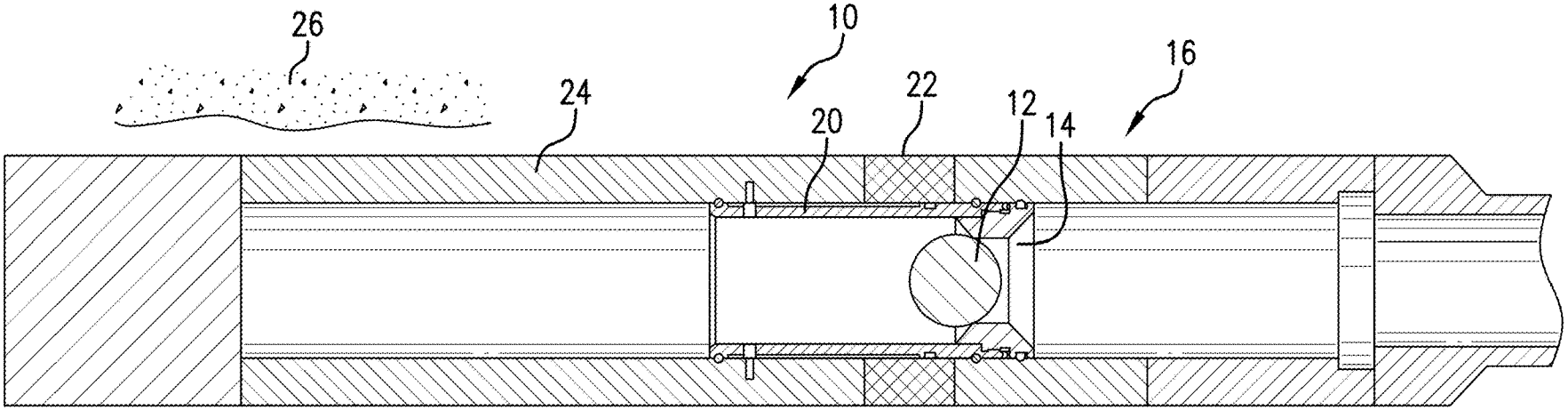
FIGS. 1-5 illustrate a first tool in a borehole subsystem with sequential operational views.
Figure 2:
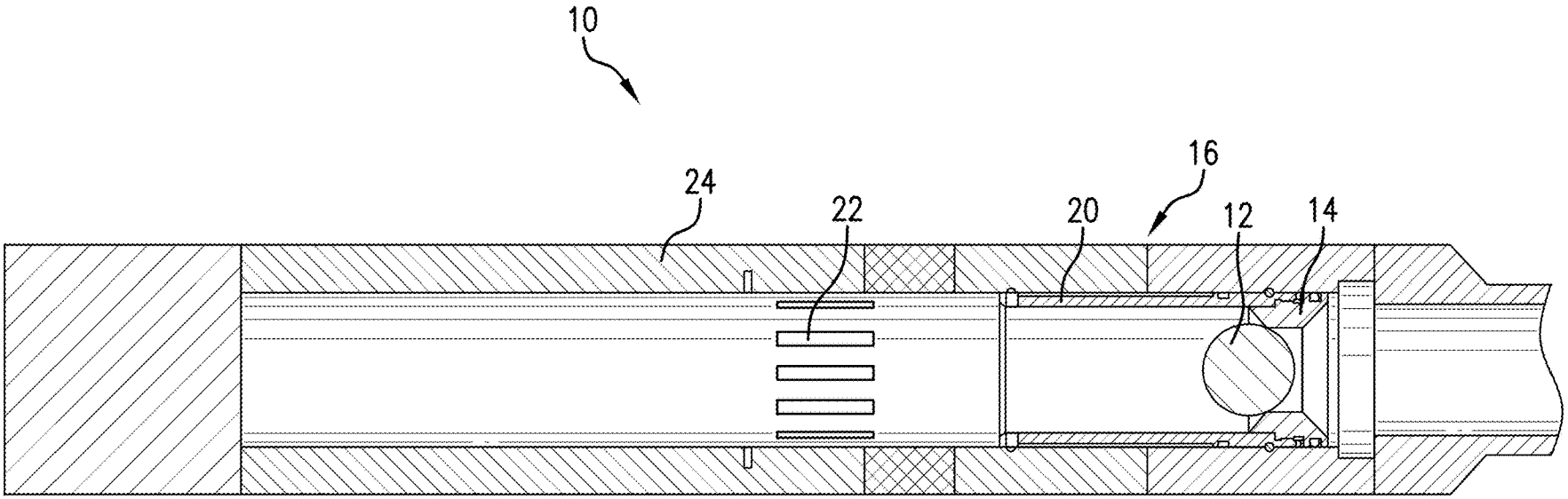
Figure 3:
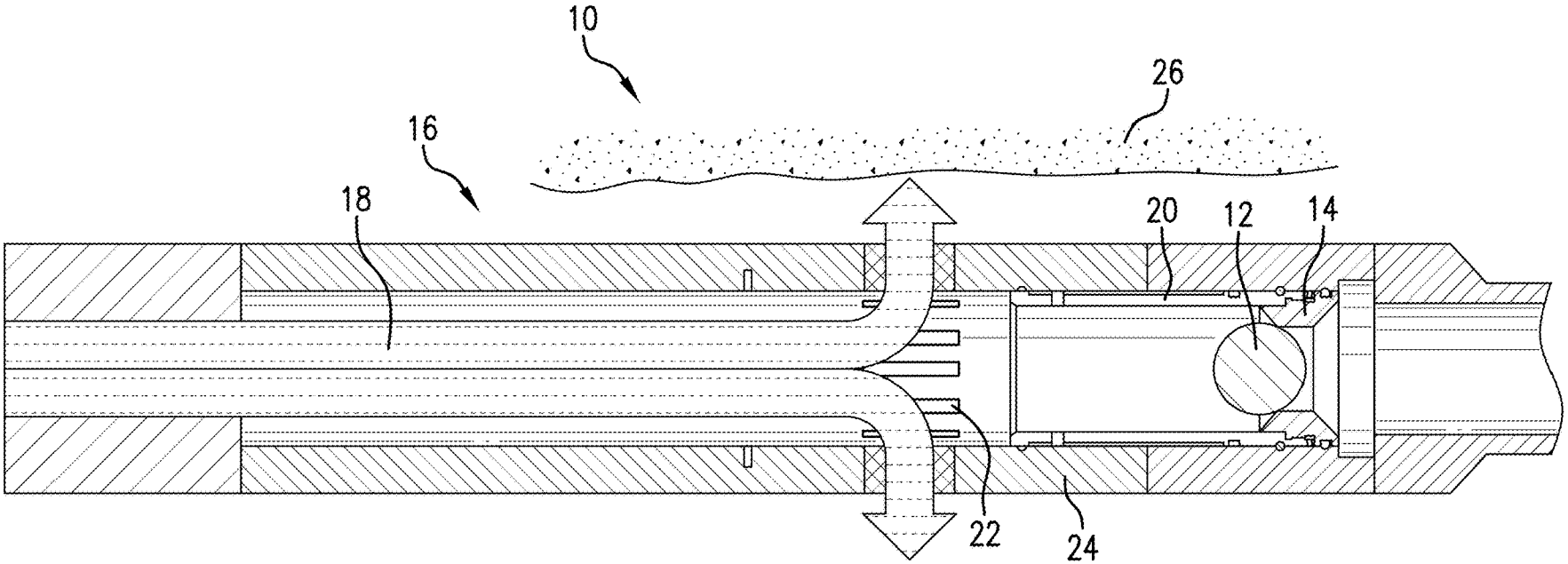

Referring to FIGS. 1-5, a borehole subsystem 10 is illustrated in several sequential operational views with an object 12 having particular properties. Object 12 comprises a volume of material that in a first condition (e.g. as illustrated in FIG. 1) is landable upon a landing seat 14 in a first tool 16 of the borehole subsystem 10. The object 12 is of dimension and/or geometry to, when landed on the landing seat 14 and with application of pressure, create a pressure drop across the landing seat 14 such that a function of the borehole subsystem 10 is obtainable. The application of pressure against the object 12 may come from surface, for example. In the illustrations, the function of the borehole subsystem 10, associated with the first tool 16 is to facilitate the employment of a fracture fluid 18 through the opening of a fracture sleeve 20 to perform a fracture operation. This operation is illustrated in sequence in FIGS. 1-3. FIG. 1 illustrates the landing of the object 12 on the landing seat 14. FIG. 2 illustrates the result of having applied pressure to the object 12 and landing seat 14. The result is that the sleeve 20 is shifted (to the right of the drawing) to expose a port 22 in a tool housing 24. In FIG. 3, fracture fluid 18 is illustrated being applied through tool 16 to a formation 26 outside of the tool 16. As will be recognized, the views of FIGS. 1-3 are not unfamiliar to those of skill in the art, however, the functioning of the subsystem 10 by the original object 12 would end at this point. Referring to FIGS. 4-9, however, it will be appreciated that the object 12 as disclosed herein provides additional functionality that will not be familiar to those of skill in the art.

Figure 4:
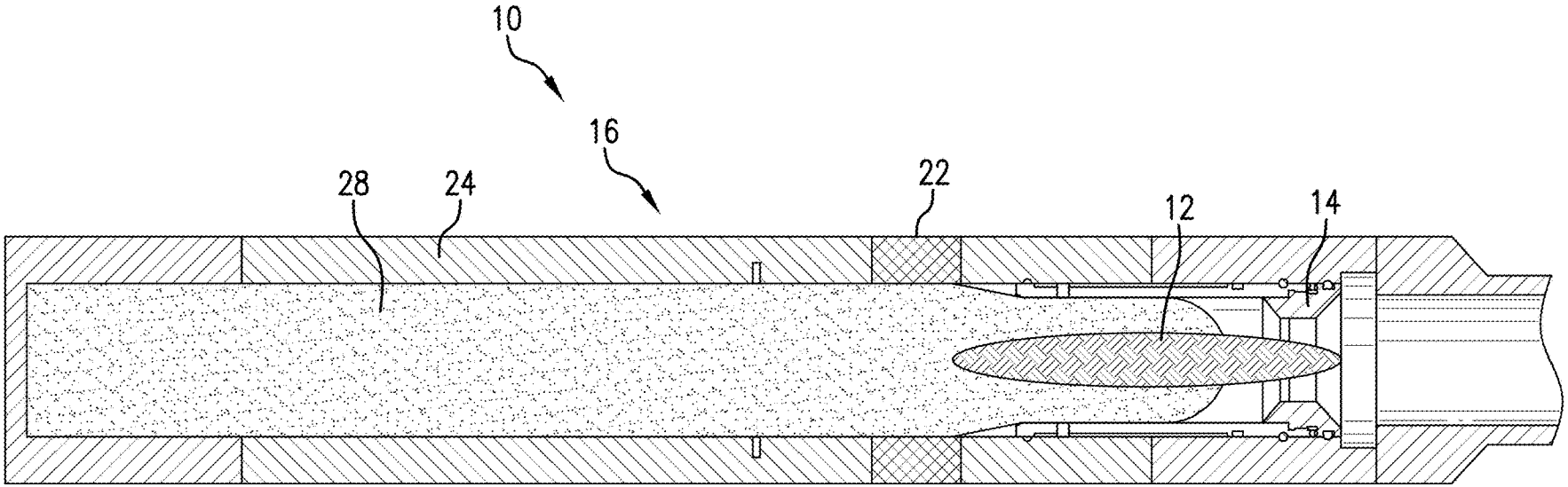
Figure 5:
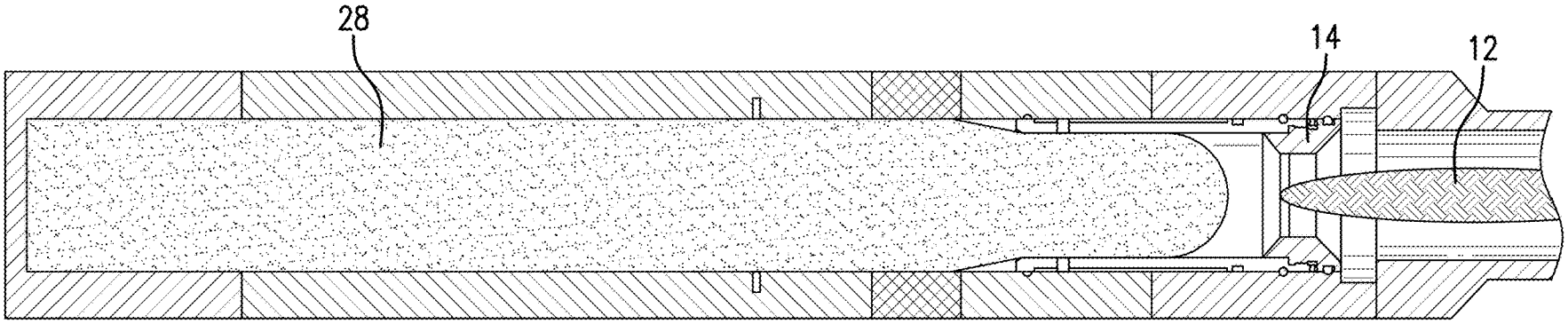

Moving to FIG. 4, a second condition of the object 12 wherein at least a portion of the volume of the object 12 is passable through the landing seat 14 is illustrated. In a first embodiment disclosed herein, the at least a portion of object 12 is all or substantially all of the object 12. That portion (substantially all) passes through the landing seat 14 due to a change in the geometry of the object 12. The change may be due to the acquisition of a transition temperature or due to the application of an actuating fluid (illustrated schematically and identified in FIG. 4 with numeral 28, though optional), or both. In the case of acquisition of temperature, this may be simply due to time in position and warming to borehole temperature or could be due to the employment of a heater such as an electric heater, chemical heater, etc. disposed operationally close enough to facilitate the raising of the temperature of the object 12 to reach its transition temperature. The transition may be a glass transition where the object 12 changes geometry to a second remembered shape or may be a change in the properties of the object 12 to allow the stated passage through the landing seat 14. Once a transition is achieved, the object 12 (or portion thereof discussed hereinafter) may proceed through the landing seat 14, which is illustrated in FIG. 5.

Figure 6:
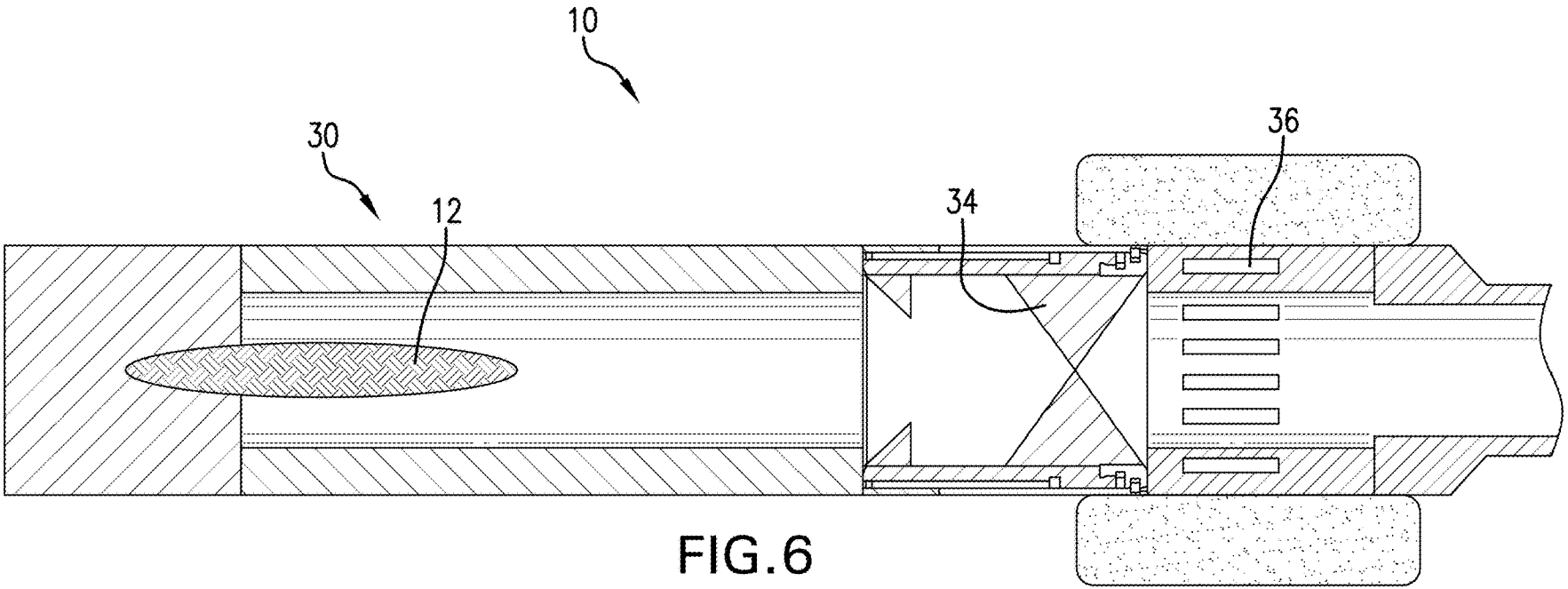
FIGS. 6-9 illustrate a second tool of the borehole subsystem with additional sequential operational views.
Figure 7:
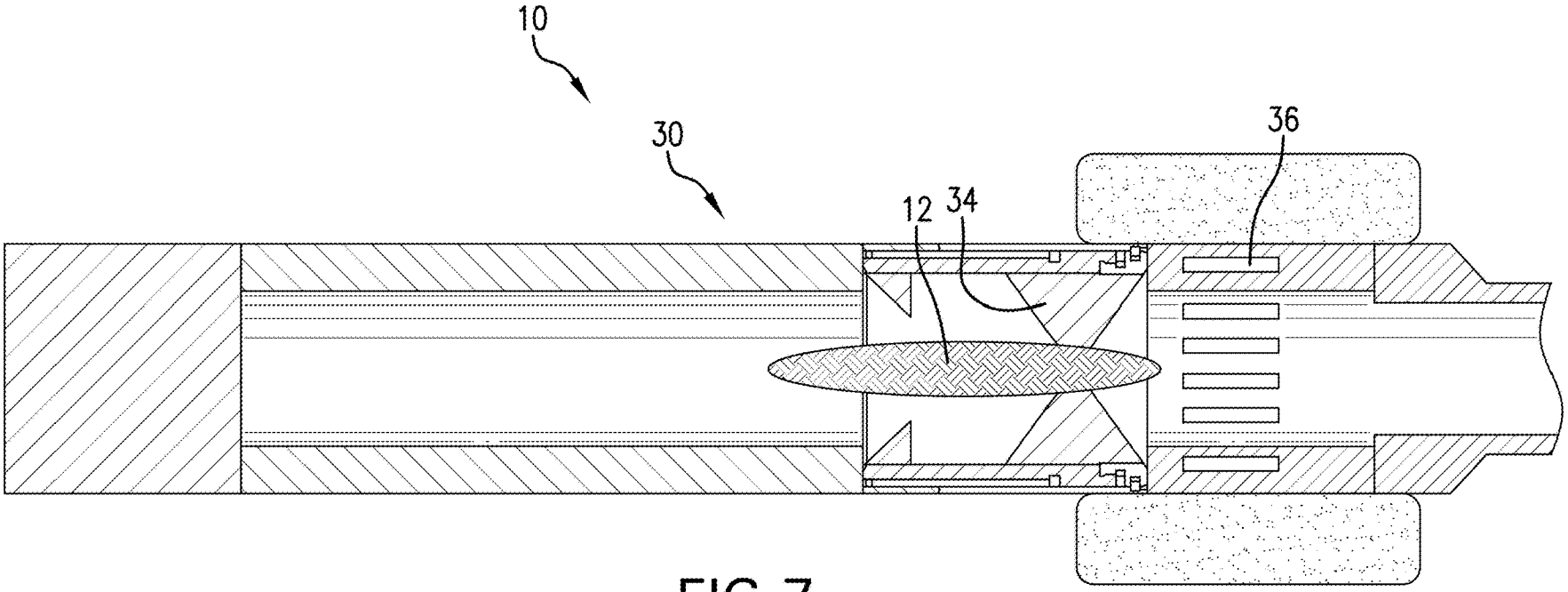

FIGS. 6 and 7 illustrate the object 12 in the second condition moving into the second tool 30, which, as illustrated, is a production tool. It is to be appreciated that tool 16 and tool 30 are illustrated as they are only for purposes of example. Other tools are contemplated where the operational benefits of the disclosure herein would be useful.

Figure 8:
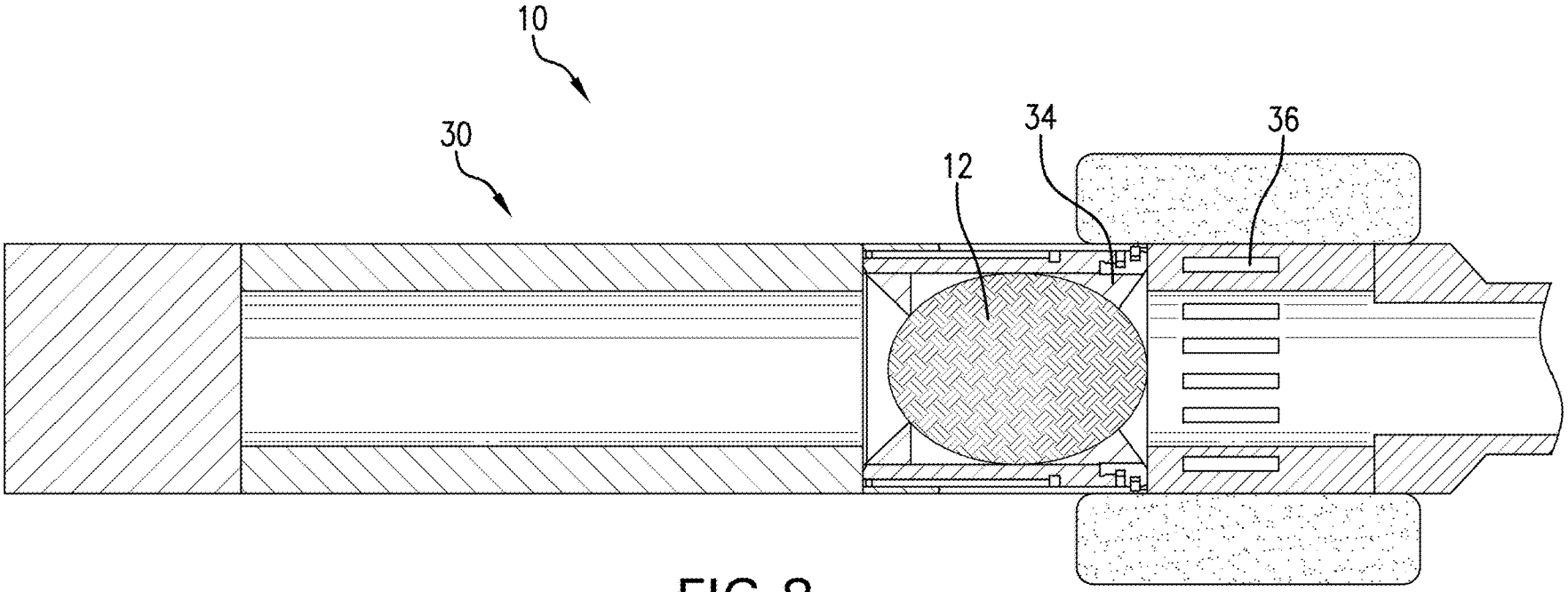
Figure 9:
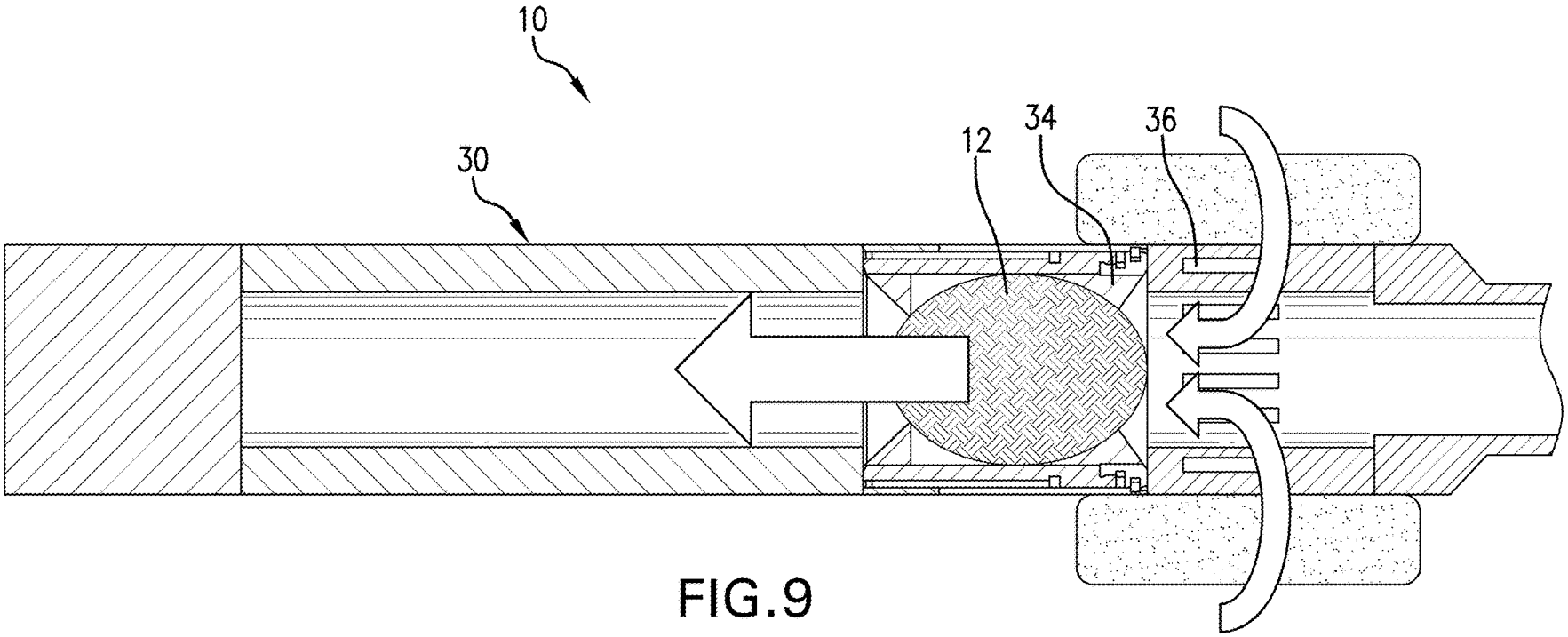

Referring to FIGS. 7 and 8, the object 12 in the second condition can be seen entering an anchor 34 in the second tool 30. The object 12 will then undergo yet another transition in shape to attain a third condition (FIG. 8) where the object 12 has expanded and reduced its density so that it is in a condition to function as a filter media. In the case of a polymeric shape memory material such as GeoForm™ commercially available from Baker Hughes, Houston Texas (a Polyurethane material), the length of time at temperature will continue to cause the transition of the material to a less and less dense material. Therefore, it will readily become a filtration material if permitted to do so in the context of the disclosure hereof and will have utility as a filtration media in a specific place in the borehole subsystem 10 due to the configuration of the second tool 30 as described. The third condition may be for only a portion of the object 12 as discussed hereunder or all of the object 12. In the third condition the object 12 has expanded into interference contact with the anchor 34. Anchored as such, the object 12 in the third condition will not move in the borehole but will filter particulate from fluids flowing therethrough from production ports 36. This is illustrated in FIG. 9.

One possible material that responds predictably to temperature transition and supports both more dense properties and more porous properties is a shape memory polymer such as GeoForm™ as noted above but other materials such as embedded PEEK (Polyether Ether Ketone) are also contemplated. These materials allow for predefined first and second shapes with the reaching of a glass transition temperature but also allow for a third shape/function due to increasing porosity with temperature and/or actuation fluid. This can be achieved by using a layered or "embedded" stack of materials, or a "ball within a ball" concept. In this iteration, the compacted "ball within a ball" (shape 1) is dropped to target 1 to shift the tool. It then mechanically or through temperature/chemical means expands or sluffs off the outer "ball" layer. The new shape (shape 2) is of the size to be able to leave target 1 and proceed to target 2 where it is trapped. At target 2, the trapped ball material is then expanded to a screen material to serve target 2 with production screen.

Figure 10:
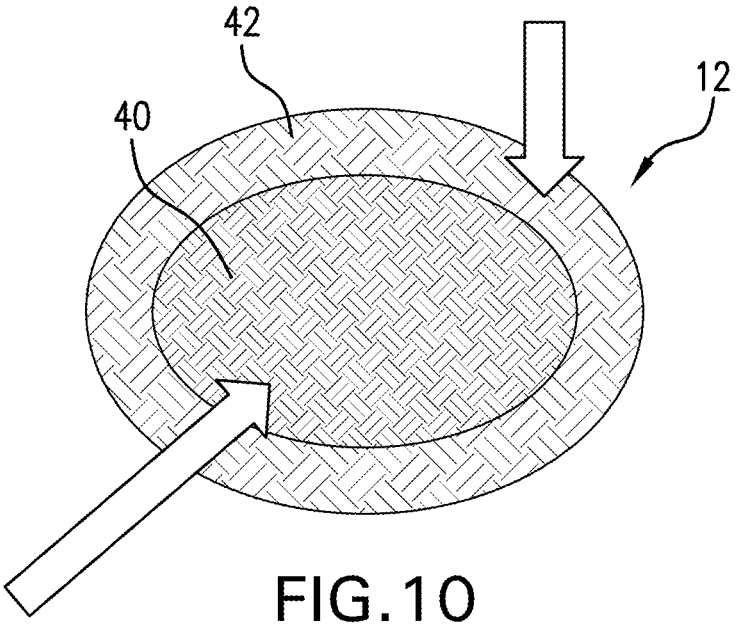
FIG. 10 illustrates an alternate object configuration.
Figure 11:
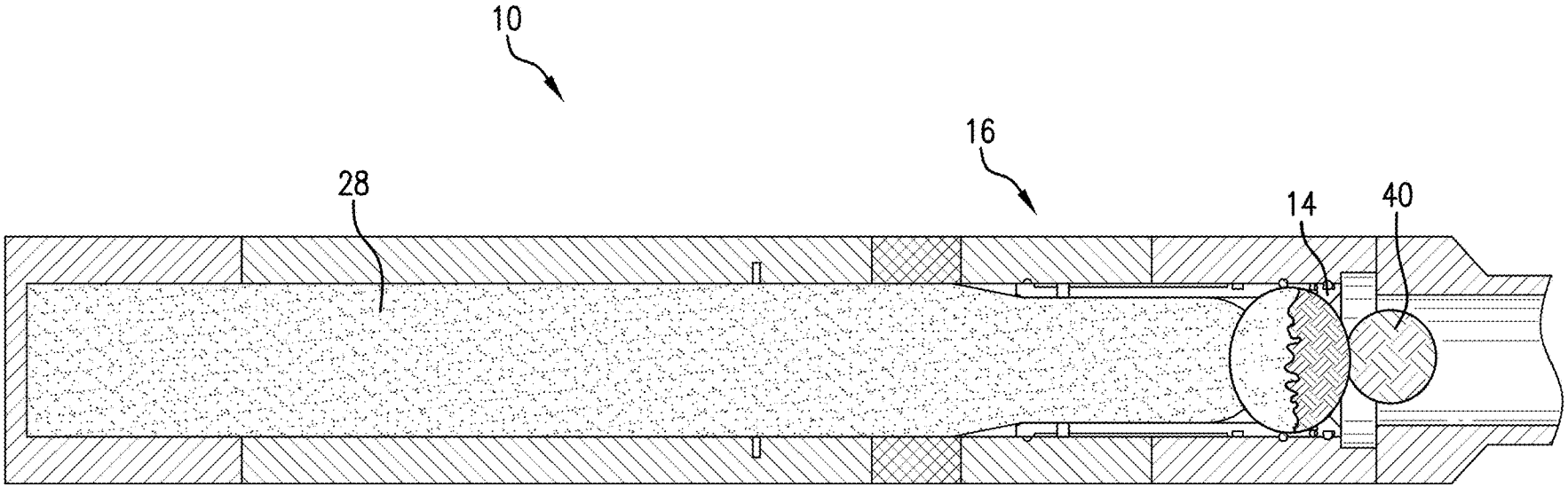
FIG. 11 illustrates operation of the alternate object in the first tool in a view similar to FIG. 4.

Referring to FIG. 10, an alternate embodiment of object 12 is illustrated. It will be evident to the observer that this embodiment includes a core 40 and a shell 42. The material of the core 40 and the shell 42 may be of the same material or different material, or even may be the same material but having different properties between the core and shell such as distinct glass transition temperatures for each, for example. The FIG. 10 embodiment would be employed in the same or similar manner as illustrated in FIGS. 1-9 and should be considered a substitute for the object 12 illustrated in those views. The FIG. 10 embodiment functions slightly differently in that the shell 42 is to be discarded in some way to allow the core 40 to pass through the landing seat 14 at the desired time without requiring the changing of the geometry of the core 40. This is illustrated in FIG. 11. The desired time is, similar to the above, after the functioning of the landing seat 14, i.e. after pressuring up on the landed object 12 against the landing seat 14 and shifting the landing seat 14 or other functioning of tool 16. The shell 42 may be discarded through the action of attaining temperature to allow the shell 42 to change consistency and essentially loose structural integrity, or may be discarded through an activation fluid to create the same type of consistency change or to degrade, dissolve, corrode or otherwise make the shell 42 disappear, etc. For example, the shell 42 may be a degradable material such as a corrodible electrolytic material available from Baker Hughes, or a disappear-on-demand material available from Baker Hughes, or a shape memory polymer similar to GeoForm™ available from Baker Hughes, or other materials that support the functions as described herein.

In one embodiment of the FIG. 10 type object 12, the shell 42 may react to a first temperature to change its ability to stay intact on the landing seat 14 thereby allowing the core 42 to pass through the landing seat 14 following functioning of the first tool 16. In such an embodiment, it would be understood that the core 42 would not react to that first temperature but rather would possess a higher temperature threshold for a transition. For example, the core 42 may react to a second higher temperature to transition into a filtration media in the third condition. In other respects, the embodiments employing a core and shell configuration work similarly to the foregoing explanation of FIGS. 1-9.

Figure 12:
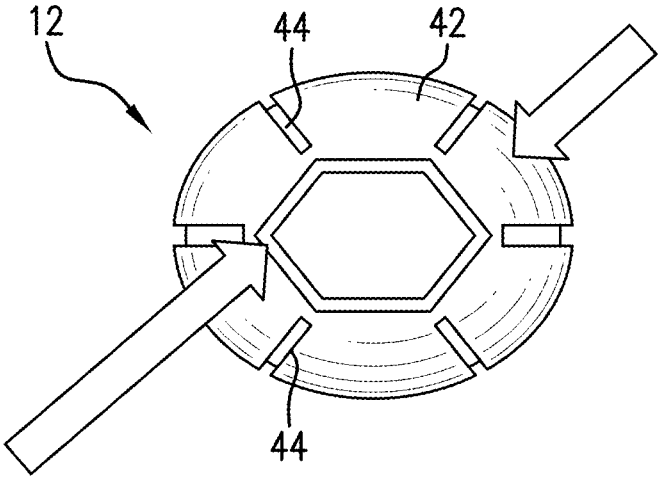
FIG. 12 is another alternate object configuration.

Referring to FIG. 12, another alternate embodiment of object 12 is illustrated. In this case, the object will still use a core/shell configuration but the shell 42 is configured with grooves 44 therein that provide more ready access to the core 40 (by temperature or actuation fluid, or both) if there is a need for premature transition to a filtration media (i.e. before the passing of the object 12 through the landing seat 14), this is a contingency type of arrangement in case an operator has a specific unanticipated need. The grooves 44 may cause some leakage of fluid pressure past the seated object 12 but not enough to prevent the pressure-based functioning described above. The grooves 44 may either remove the shell 42 entirely at the position of the grooves 44 or remove the shell 42 partially at the position of the grooves 44. This will allow greater access to the core 40 by either temperature or activation fluid or both as noted so that the object 12 could be transitioned to the third configuration to create a filtration media while still on the landing seat 14.

Figure 13:
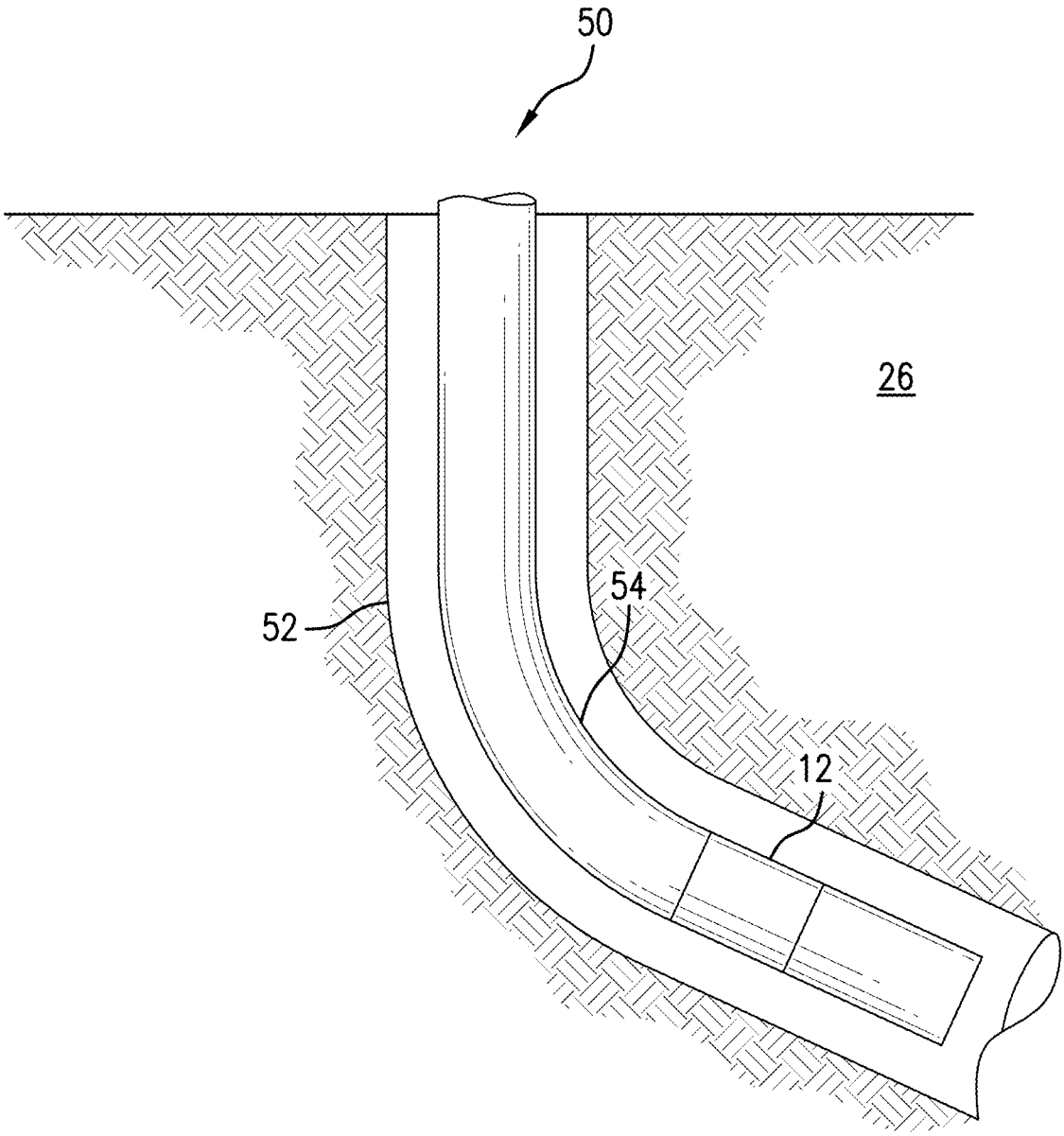
FIG. 13 is a view of a borehole system including the object as disclosed herein.

Referring to FIG. 13, a borehole system 50 is illustrated. The system 50 comprises a borehole 52 in a subsurface formation 26. A string 54 is disposed within borehole 52. An object 12 as disclosed herein is disposed within the string 54.

Set forth below are some embodiments of the foregoing disclosure:

Embodiment 1: A tripping and filtration object to manage a borehole operation, including a volume of material that in a first condition is landable upon a landing seat in a borehole system, the volume being of dimension and/or geometry to create a pressure drop across the landing seat such that a function of the borehole subsystem is obtainable by the application of pressure against the volume of material when seated on the landing seat, a second condition of the volume wherein at least a portion of the volume is passable through the landing seat, and a third condition of at least the portion of the volume wherein the at least a portion of the volume becomes a filtration media.

Embodiment 2: The object to manage a borehole operation as in any prior embodiment, wherein the volume includes a core and a shell.

Embodiment 3: The object to manage a borehole operation as in any prior embodiment, wherein the core is the at least a portion of the volume.

Embodiment 4: The object to manage a borehole operation as in any prior embodiment, wherein the shell completely isolates the core from fluid contact in a first condition of the volume.

Embodiment 5: The object to manage a borehole operation as in any prior embodiment, wherein the shell incompletely isolates the core from fluid contact in a first condition of the volume.

Embodiment 6: The object to manage a borehole operation as in any prior embodiment, wherein the at least a portion is an entirety of the volume.

Embodiment 7: The object to manage a borehole operation as in any prior embodiment, wherein the volume is temperature and/or activation fluid dependent.

Embodiment 8: The object to manage a borehole operation as in any prior embodiment, wherein the volume includes Polyurethane, Poly Ether Ether Ketone or combinations including at least one of the foregoing.

Embodiment 9: A borehole subsystem, including a first tool including a landing seat therein configured to mate with the object, as in any prior embodiment, to create a pressure differential across the landing seat during application of pressure thereto, and a second tool, downstream of the first tool, the second tool configured to locate the object when at least the portion of the object is in a filtration media condition.

Embodiment 10: The borehole subsystem as in any prior embodiment, wherein the second tool includes an object anchor having a geometry that prevents subsequent movement of the object after the object is in the filtration media condition.

Embodiment 11: The borehole subsystem as in any prior embodiment, wherein the first tool is a frac sleeve.

Embodiment 12: The borehole subsystem as in any prior embodiment, wherein the second tool includes a production port.

Embodiment 13: A method for managing a borehole operation, including conveying an object to a landing seat in a borehole system, functioning the landing seat through application of pressure against the object on the landing seat, passing at least a portion of the object through the landing seat, and changing the at least a portion of the object into a filtration media after passing through the landing seat.

Embodiment 14: The method as in any prior embodiment, wherein the functioning is shifting.

Embodiment 15: The method as in any prior embodiment, wherein the passing includes reducing density of the object.

Embodiment 16: The method as in any prior embodiment, wherein the passing includes undermining a shell of the object.

Embodiment 17: The method as in any prior embodiment, wherein the undermining is degrading.

Embodiment 18: The method as in any prior embodiment, further including one or more of applying an activation fluid to the object, and/or attaining a predetermined temperature of the object, Embodiment 19: The method as in any prior embodiment, wherein the passing includes attaining first temperature of an outer portion of the object and the changing includes attaining a second temperature, higher than the first temperature of a core of the object.

Embodiment 20: A borehole system, including a borehole in a subsurface formation, a string in the borehole, and an object as in any prior embodiment, disposed within the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A tripping and filtration object to manage a borehole operation, comprising:

a volume of material that in a first condition is landable upon a landing seat in a borehole system, the volume being of dimension and/or geometry to create a pressure drop across the landing seat such that a function of a borehole subsystem is obtainable by the application of pressure against the volume of material when seated on the landing seat;

a second condition of the volume, prior to passing through the seat wherein at least a portion of the volume is passable through the landing seat; and a third condition of the at least the portion of the volume different from the first condition or the second condition wherein the at least the portion of the volume becomes a filtration media.

2. The object to manage a borehole operation as claimed in claim 1, wherein the volume includes a core and a shell.

3. The object to manage a borehole operation as claimed in claim 1, wherein the core is the at least a portion of the volume.

4. The object to manage a borehole operation as claimed in claim 1, wherein the shell completely isolates the core from fluid contact in a first condition of the volume.

5. The object to manage a borehole operation as claimed in claim 1, wherein the shell incompletely isolates the core from fluid contact in a first condition of the volume.

6. The object to manage a borehole operation as claimed in claim 1, wherein the at least a portion is an entirety of the volume.

7. The object to manage a borehole operation as claimed in claim 1, wherein the volume is temperature and/or activation fluid dependent.

8. The object to manage a borehole operation as claimed in claim 1, wherein the volume includes Polyurethane, Poly Ether Ether Ketone or combinations including at least one of the foregoing.

9. A borehole subsystem, comprising:

a first tool including a landing seat therein configured to mate with the object as claimed in claim 1 to create a pressure differential across the landing seat during application of pressure thereto; and a second tool, downstream of the first tool, the second tool configured to locate the object when at least the portion of the object is in a filtration media condition.

10. The borehole subsystem as claimed in claim 9, wherein the second tool includes an object anchor having a geometry that prevents subsequent movement of the object after the object is in the filtration media condition.

11. The borehole subsystem as claimed in claim 9, wherein the first tool is a frac sleeve.

12. The borehole subsystem as claimed in claim 9, wherein the second tool includes a production port.

13. A borehole system, comprising:

a borehole in a subsurface formation;

a string in the borehole; and an object as claimed in claim 1 disposed within the string.

14. A method for managing a borehole operation, comprising:

conveying an object to a landing seat in a borehole system;

functioning the landing seat through application of pressure against the object on the landing seat;

changing at least a portion of the object prior to passing at least the portion of the object through the landing seat; and changing the at least a portion of the object into a filtration media after passing through the landing seat.

15. The method as claimed in claim 14, wherein the functioning is shifting.

16. The method as claimed in claim 14, wherein the passing includes reducing density of the object.

17. The method as claimed in claim 14, wherein the passing includes undermining a shell of the object.

18. The method as claimed in claim 17, wherein the undermining is degrading.

19. The method as claimed in claim 14, further including one or more of applying an activation fluid to the object, and/or attaining a predetermined temperature of the object.

20. The method as claimed in claim 14, wherein the passing includes attaining first temperature of an outer portion of the object and the changing includes attaining a second temperature, higher than the first temperature of a core of the object.

* * * * *